United States Patent [19]

Beres et al.

[11] 3,998,363

[45] Dec. 21, 1976

[54] SPRAY DISPENSER PUMP ASSEMBLY

[75] Inventors: Steven W. Beres, Bridgeport; Richard J. Nash, Monroe, both of Conn.

[73] Assignee: VCA Corporation, Baton Rouge, La.

[22] Filed: July 31, 1975

[21] Appl. No.: 600,839

[52] U.S. Cl. ..... 222/321

[51] Int. Cl.[2] ..... B65D 47/28

[58] Field of Search ..... 222/321, 320

[56] References Cited

UNITED STATES PATENTS

| | | | |
|---|---|---|---|
| 2,729,506 | 1/1956 | Ziherl et al. | 222/321 X |
| 3,228,570 | 1/1966 | Steiman | 222/321 |
| 3,229,864 | 1/1966 | Roder | 222/321 |
| 3,248,021 | 4/1966 | Corsette et al. | 222/321 |

*Primary Examiner*—Allen N. Knowles
*Assistant Examiner*—Hadd Lane
*Attorney, Agent, or Firm*—Donald L. Johnson; John F. Sieberth; David L. Ray

[57] ABSTRACT

A hand-operated, spray dispenser pump assembly for use on a container having an outwardly extending bead adjacent its top opening, for example, an aerosol-type can. The pump is attached to the container by means of a special snap-on closure member. The closure member is molded from a somewhat resilient, strong, thermoplastic material and includes a top wall having an opening for the stem of the pump and a depending skirt which is provided with an inwardly facing, annular bead on its inner walls adapted to be snapped over the outwardly extending, complementary bead on the top of the container. The pump is provided with an integral annular flange adjacent its top opening, which flange is snap fitted inside the special closure member. An annular rubber gasket is provided around the periphery of the pump flange and makes a leak-proof sealing engagement with the top opening in the container when the special closure is snapped down over the top of the container.

5 Claims, 5 Drawing Figures

SPRAY DISPENSER PUMP ASSEMBLY

CROSS-REFERENCE TO RELATED APPLICATIONS

The present application is related to co-pending U.S. applications Ser. No. 133,508, filed Apr. 13, 1971, now U.S. Pat. No. 3907,174 of Sept. 23, 1975; Ser. No. 476,039, filed June 3, 1974, now U.S. Pat. No. 3,934,763 of Jan. 27, 1976; Ser. No. 458,338, filed Apr. 5, 1975, now U.S. Pat. No. 3,937,366 of Feb. 10, 1976; and Ser. No. 509,485, filed Sept. 26, 1974, all applications having common ownership with the present application.

BACKGROUND OF THE INVENTION

1. Field of the Invention

This invention relates to a hand-operated spray pump dispenser assembly adapted to be attached to a container having a bead adjacent its top opening.

2. Description of the Prior Art

Heretofore, hand-operated dispenser spray pumps have been customarily attached to containers such as bottles or cans by utilizing a threaded screw cap which has an opening in the center thereof for the pump stem to project through. The container to which the pump is attached normally has an upstanding neck with threads on the outside adapted to make engagement with the threads on the inner skirt of the closure cap. Recently there has been considerable interest by manufacturers of products normally dispensed in conventional aerosol containers to adapt hand-operated spray dispensers to aerosol-type containers so that the products may be marketed in the same containers used heretofore, but dispensed by means of hand-operated spray rather than the conventional pressurization with fluorocarbons or other propellant gases as in the conventional aerosol package. Related applications Ser. Nos. 476,039 and 509,485 disclose hand-operated spray dispenser pumps attached to aerosol-type metal containers and also to bottles or cans having a non-threaded neck. While the foregoing spray pump-container combinations are admirably suited for use in packaging and dispensing many different products, nevertheless, there is still a need for an improved spray dispenser pump assembly which would provide a greater assurance of a leak-proof connection between the mounting assembly and the container and also which provides for utilization of standard pumps that are normally used in threaded neck containers.

SUMMARY OF THE INVENTION

It is an object of the present invention to provide an improved hand-operated spray-type pump dispenser assembly which can be attached to the top opening of a container having a bead adjacent its top opening.

It is another object of the present invention to provide a hand-operated spray pump dispensing assembly which utilizes an aerosol-type container.

It is also another object of the present invention to provide an improved hand-operated spray pump dispensing attachment assembly which can attach a pump to an aerosol-type container to provide a leak-proof seal.

The above and other objects of the present invention are accomplished in one embodiment by a spray dispenser assembly for a container having an outwardly extending bead adjacent its top opening. The spray dispenser assembly includes a hollow pump body having a movable stem extended outwardly from the top opening provided in the pump body. An annular, radially extending mounting means is coupled to the pump body adjacent its top opening. An annular gasket is positioned on the underside of the mounting means adjacent to its periphery. A snap-on plastic closure having a generally cylindrical top section with a central opening therein to receive the stem and an integral skirt section depending from the top section, which skirt section has an inwardly facing detent means on the lower wall of the skirt section, is utilized to retain the pump and gasket on the top of the container. The closures are adapted to abut at least a portion of the top surface of the mounting means and to press the peripheral portion thereof and the gasket into a liquid-tight seal with the bead of the container when the closure is press-fitted onto the container whereby the detent means on the skirt engages the outwardly extending bead on the container to securely hold the spray pump dispenser on the container.

DESCRIPTION OF THE PREFERRED EMBODIMENTS

Figure 1:
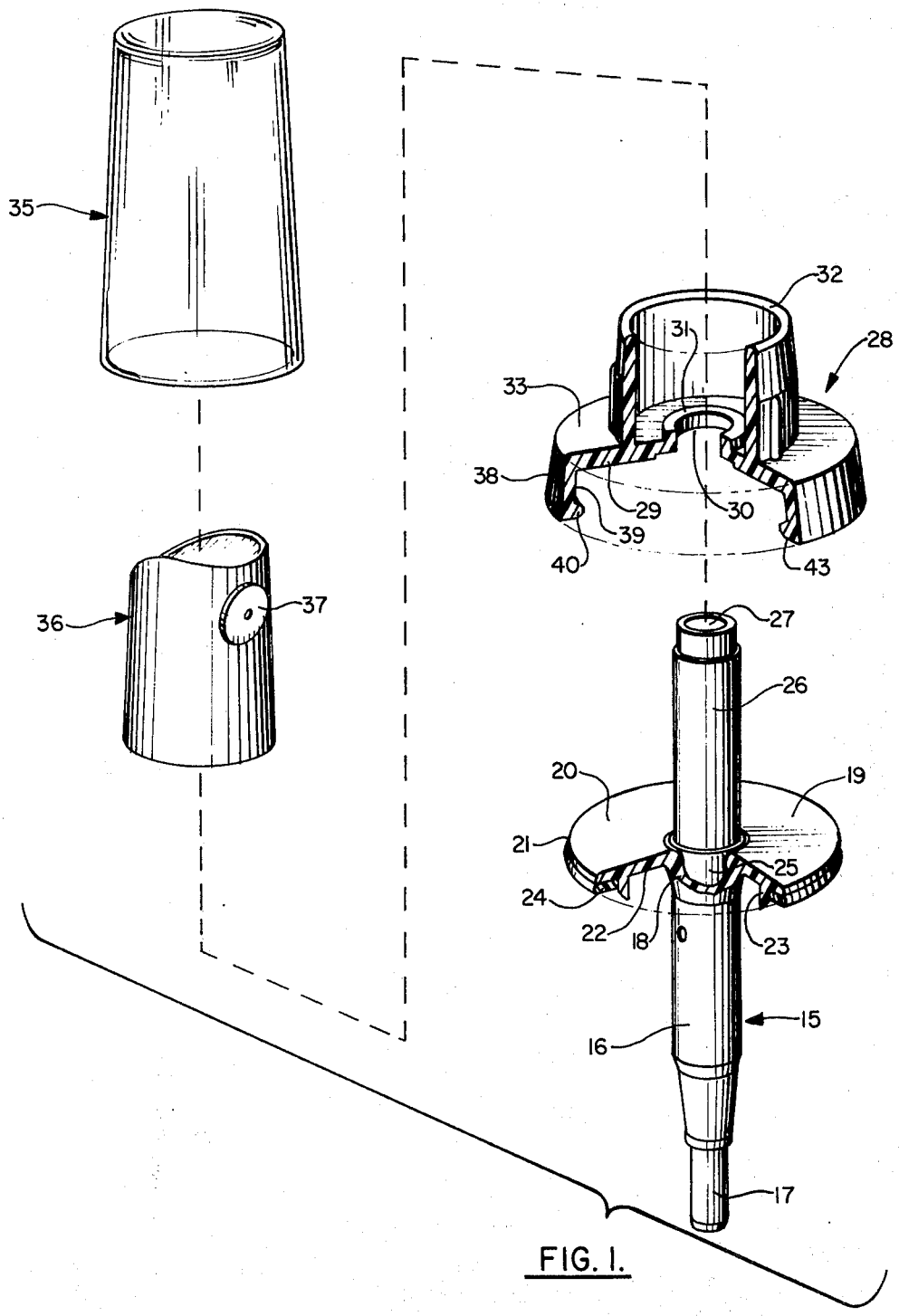
FIG. 1 is an exploded, elevational, perspective view, partially in section, of one embodiment of the hand-held dispenser spray pump assemblage of the present invention.

Referring now to FIG. 1, the improved hand-operated spray dispenser pump assembly of the present invention includes a pump assembly, designated generally by the numeral 15. The pump assembly includes a pump cylinder or body 16 having a reduced diameter portion 17 at its lower end to which is attached the conventional dip tube (not shown) which extends to the bottom of the container. The upper end of the pump body 16 has integrally formed therewith and extending radially therefrom an annular, one-piece, pump mounting flange 19. The top surface 20 of the mounting flange is preferably flat and its peripheral edge 21 is slightly radiused, as can be seen more clearly in FIG. 5, for reasons given hereafter. The bottom surface 22 of the mounting flange is also generally flat and is provided with an integrally formed, downwardly directed annular collar 23 spaced inwardly from its periphery. The lower end of the annular collar is provided with an outwardly beveled surface 23*a*.

An annular gasket or washer 24 is received over the collar 23 and makes sealing contact with the annular portion of the underside of the mounting flange extending from the collar 23 to approximately the outer edge of the mounting flange 19. The gasket 24, while shown as having generally flat surfaces, may have other suitable shapes.

The pump body 16 has a central opening 25 at its upper end which receives the lower portion of the pump stem or actuator 26. The pump stem 26 is provided with a longitudinal passage 27 for transmission of the fluid from the pump body 16 to the spray dispenser head as will be subsequently described.

It is understood that the pump assembly 15 contains inside the body 16 the conventional piston, spring, check valves, and other necessary components to make an effective pump. The present invention can utilize any of the many commercially known and available pump constructions for hand-operated spray pumps. For example, the pump shown in the following U.S. patents may be utilized: U.S. Pat. Nos. 3,159,316; 3,185,354, 3,198,403, or 3,288,570.

A snap-on closure member, designated generally by the numeral 28, is utilized to attach the pump assembly 15 and the gasket to the top of the container. The closure includes a generally planar top portion 29 having a central opening 30 therein. The opening 30 is surrounded by an integrally formed, upwardly projecting, reinforcing and stop ring 31. A generally cylindrical collar 32 is integrally formed with and attached to the top surface 33 of the top portion of the cap and is concentric with the opening 30. As seen more clearly in FIG. 2, the outer sidewall 34 of the collar has a slight inward slope in order to make a press-fit with the generally cylindrical cover cap, designated generally by the numeral 35.

Figure 2:
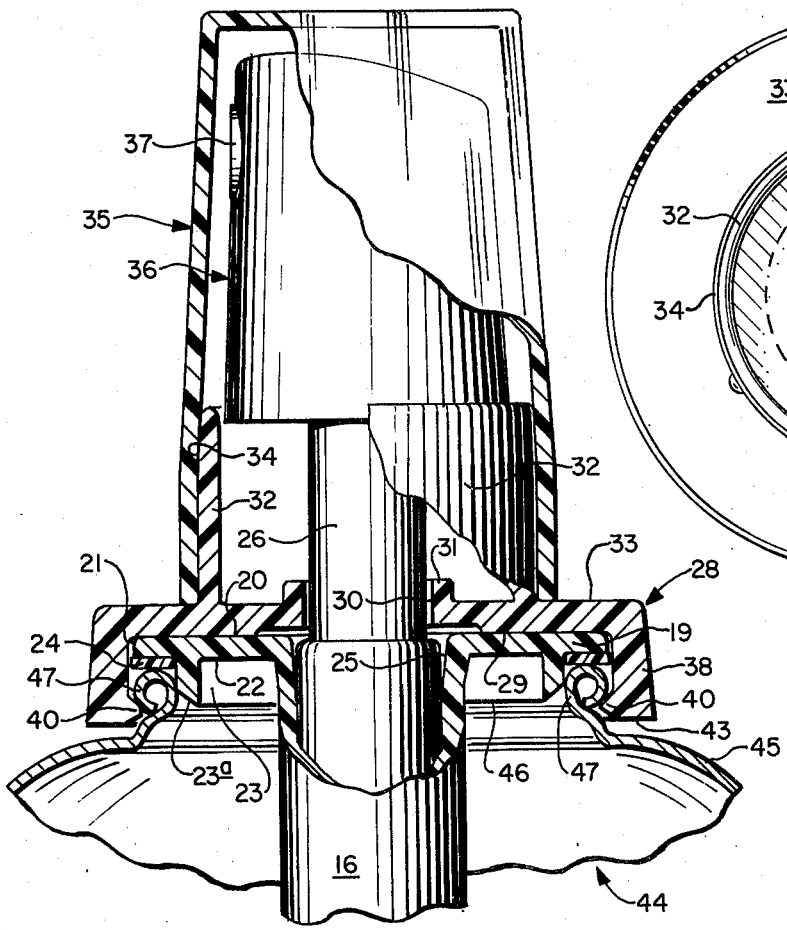
FIG. 2 is an enlarged, elevational, partially sectional, partially broken view of the dispenser pump assembly of FIG. 1 shown attached to an aerosol-type can.
Figure 3:
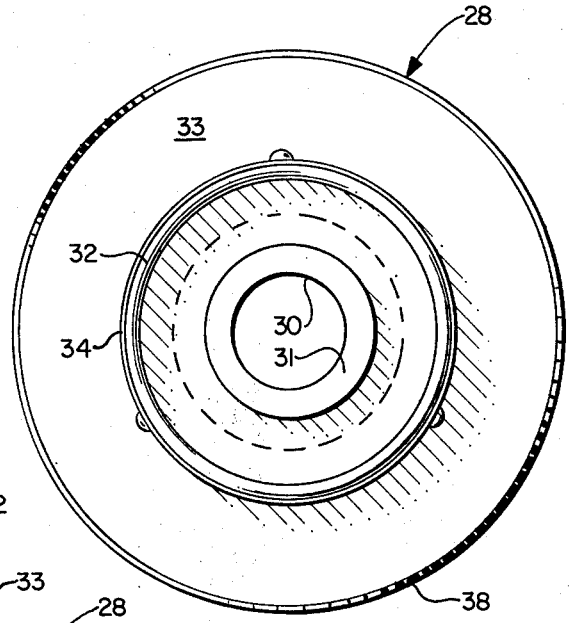
FIG. 3 is a top plan view of the plastic closure member as seen in FIGS. 1 and 2.
Figure 4:
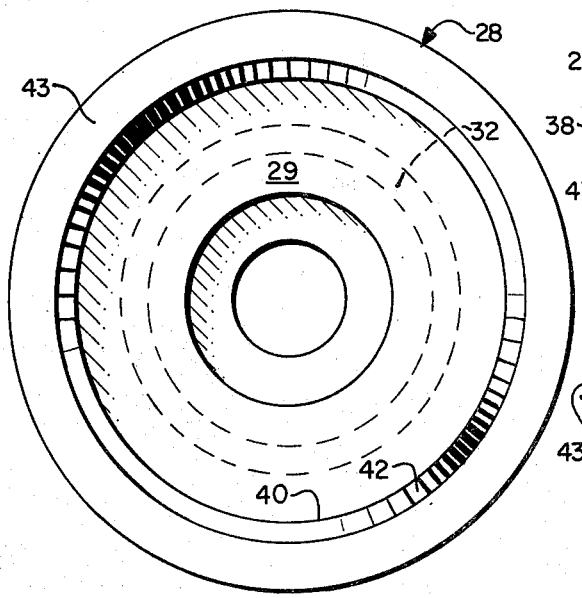
FIG. 4 is a bottom plan view of the plastic closure member as seen in FIGS. 1 and 2.

As seen in FIGS. 1 and 2, the pump stem 26 receives on its outer end a spray or atomizer dispenser button, designated generally by the numeral 36. The dispenser button 36 is provided with the usual insert member 37. Closure member 28 includes a downwardly directed, integral, annular skirt portion 38. The inner wall of the skirt portion 38 is provided with a longitudinally extending recess or undercut portion 39. The recess 39 terminates in its lower end in an inwardly projecting, annular bead or detent 40. As seen more clearly in FIG. 5, the upper wall 41 of the bead 40 slopes downwardly and inwardly, and the lower wall 42 slopes upwardly and inwardly from the bottom surface 43 of the closure cap.

In assembling the spray pump assembly of the present invention, the pump 15 components are assembled and then the washer 24 is placed on the underside of mounting flange 19. These top components are then joined to snap-on closure member 28 by forcing the radiused peripheral edge 21 of the mounting flange 19 to cam against the upwardly sloping lower surface 42 of the bead 40 to snap these components up into the underside of the closure 28 so that the stem 26 will project through the opening 30 in the closure. This assembly can conveniently take place at the pump manufacturing plant and additionally the spray button, complete with spray insert 37, can be attached to the stem 26 and the dust cover placed over the collar 32. If desired, the conventional dip tube of appropriate length can be attached to the lower end 17 of the pump. Thus, the complete pump assembly may be packed in suitable quantities and shipped to the user who will attach the spray pump assembly to an aerosol-type can or the like.

The novel spray pump assembly of the present invention is adapted to be utilized with any container having a cylindrical neck portion surrounding its top opening, which neck portion is provided with suitable mating detent means adapted to receive the annular, inwardly projecting bead or detent 40 on the closure or cover cap 35. Thus, the spray pump assembly of the present invention lends itself readily to attachment to containers such as glass or plastic bottles having an annular groove adjacent the upper end of its neck or to metal cans having grooves or recesses in the outer surface of its neck which can receive a detent or bead means 40 of the closure cap to securely attach the spray pump to the container. The spray assembly of the present invention is particularly adapted for attachment to metal pressure-resistant cans such as those used to package products that are dispensed by a pressurizing container with a propellant, such as a fluorocarbon, or other suitable pressurizing material. However, as noted heretofore. the utilization of the hand-operated spray pump dispenser of the present invention with aerosol-type cans permits the products to be dispensed without the necessity of pressurizing the contents with a gas and obviates the use of the special aerosol dispensing devices which normally close the container.

Figure 5:
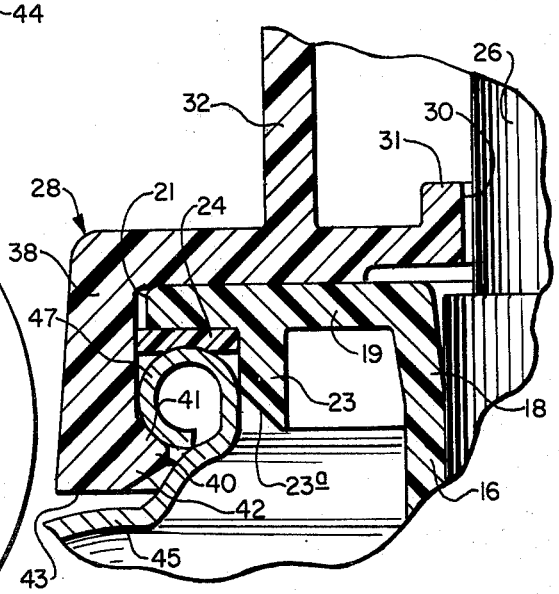
FIG. 5 is a broken, enlarged, elevational, sectional view of a portion of the pump assembly-container combination as seen in FIG. 2.

Referring now particularly to FIGS. 2 and 5, the assembled, hand-operated spray dispenser device of the present invention is attached to a metal aerosol can, designated generally by the numeral 44. The aerosol can has a crowned top portion 45 which terminates in its upper end in an opeing 46. The crown portion 45 of the can terminates at it upper end in an outwardly turned curl or bead 47. The bead or curl 47 thus constitutes the top rim of the can.

After the aerosol-type can 44 is filled with the product desired to be dispensed, the assembled hand-operated pump dispenser assembly is pressed downwardly against the annular bead or curl 47, thereby expanding the skirt portion 38 of the closure permitting the inwardly directed bead 40 on the skirt to snap under the bead or curl 47 of the can, whereby the upper, inwardly and downwardly sloping surface 41 of the bead makes firm contact with the underside of the outer portion of the curl 47. The top portion 29 of the closure member 28 presses the outer periphery of the mounting flange 19 into sealing engagement with the washer 24 which, in turn, is pressed into sealing engagement with the rim of the curl 47, thereby providing a leak-proof seal between the rim or curl 47 of the container and the spray dispensing assembly. The annular collar 23 on the bottom of the mounting flange 19 makes contact on its outer face adjacent the upper end of the beveled surface **23*a* with the inner face of the bead or curl 47, thus insuring that the assembly is properly centered in the opening 46 of the can and also providing a supplemental seal between the collar 23 and the curl 47.**

What is claimed is:

1. A spray dispenser assembly for a container having an outwardly extending bead adjacent its top opening comprising:

a. a pump cylinder and protruding plunger carried thereby, said cylinder at its mouth having an annular, integral, one-piece, outwardly extending mounting flange, said mounting flange having an integral, depending, annular collar spaced inwardly of the periphery of said flange and adapted to hold an annular gasket in position on the underside thereof; and, b. a snap-on plastic closure comprising an inverted, dish-shaped member having:

i. a disk-like body provided with a central opening through which said plunger extends and in which said plunger is reciprocable; and, ii. an integral, depending, peripheral skirt having an annular undercut closely adjacent the disk-like body for receiving and holding captive said mounting flange of the pump cylinder with the top of said mounting flange engaged by the underside of the disk-shaped body, said peripheral skirt having in its inside wall an annular bead for engaging the lower outer portion of said bead of said container when the closure is snapped over the top opening thereof to form a liquid-tight seal between said mounting flange, said gasket and said bead of said container.

2. The spray dispenser of claim 1 wherein said disk-like body is provided with an annular, integral, upstanding collar on its top surface and said stem has attached to its upper end a generally cylindrical actuator having its lower end received within said collar.

3. The spray dispenser of claim 2 wherein a generally cup-shaped cover is freely received over said actuator and has its lower end frictionally fitted over the exterior of said upstanding collar.

4. The spray dispenser of claim 3 wherein said depending collar has a length and an outside diameter such that it makes contact with the inside of said bead on said container.

5. A spray dispenser assembly for a container having an outwardly extending bead adjacent its top opening comprising:

a. a pump cylinder and protruding plunger carried thereby, said cylinder at its mouth having an annular, integral, one-piece, outwardly extending mounting flange, said mounting flange having an integral, depending, annular collar spaced inwardly of the periphery of said flange and adapted to hold an annular gasket in position on the underside thereof, said depending, annular collar having a length and an outside diameter such that it makes contact with the inside of said bead on said container; and, b. a snap-on plastic closure comprising an inverted, dish-shaped member having;

i. a disk-like body provided with a central opening through which said plunger extends and in which said plunger is reciprocable;

ii. an integral, depending, peripheral skirt having an annular undercut closely adjacent the disk-like body for receiving and holding captive said mounting flange with the top of said mounting flange engaged by the underside of the disk-shaped body, said peripheral skirt having in its inside wall an annular bead for engaging the lower outer portion of said bead of said container when the closure is snapped over the top opening thereof to form a liquid-tight seal between said mounting flange, said gasket and said bead of said container; and, iii. an annular, integral, upstanding collar on the top surface of said member and said plunger has attached to its upper end a generally cylindrical actuator having its lower end received within said collar.

* * * * *